US010935336B2

(12) United States Patent
Nilsson

(10) Patent No.: US 10,935,336 B2
(45) Date of Patent: Mar. 2, 2021

(54) SYSTEM AND METHOD FOR THE REVERSIBLE TRANSFER OF AMMUNITION BETWEEN A PRIMARY MAGAZINE AND A SECONDARY MAGAZINE IN AN AUTOMATIC CANNON

(71) Applicant: BAE SYSTEMS BOFORS AB, Karlskoga (SE)

(72) Inventor: Andreas Nilsson, Karlskoga (SE)

(73) Assignee: BAE SYSTEMS BOFORS AB, Karlskoga (SE)

( * ) Notice: Subject to any disclaimer, the term of this patent is extended or adjusted under 35 U.S.C. 154(b) by 0 days.

(21) Appl. No.: 16/310,874

(22) PCT Filed: Jun. 20, 2017

(86) PCT No.: PCT/SE2017/050666

§ 371 (c)(1),
(2) Date: Dec. 18, 2018

(87) PCT Pub. No.: WO2017/222456

PCT Pub. Date: Dec. 28, 2017

(65) Prior Publication Data

US 2019/0178594 A1 Jun. 13, 2019

(30) Foreign Application Priority Data

Jun. 21, 2016 (SE) ..... 1630158-2

(51) Int. Cl.
*F41A 9/76* (2006.01)
*F41A 9/24* (2006.01)
(Continued)

(52) U.S. Cl.
CPC ..... *F41A 9/76* (2013.01); *F41A 9/04* (2013.01); *F41A 9/21* (2013.01); *F41A 9/24* (2013.01)

(58) Field of Classification Search
CPC ..... F41A 9/04; F41A 9/20; F41A 9/21; F41A 9/24; F41A 9/76; F41A 9/82; F41A 9/83; F41A 9/87
(Continued)

(56) References Cited

U.S. PATENT DOCUMENTS 1,504,393 A * 8/1924 Sutton ..... F41A 9/24 89/33.1
2,474,975 A * 7/1949 Goodhue ..... F41A 9/21 89/33.14
(Continued)

FOREIGN PATENT DOCUMENTS

BE 515828 12/1952
CA 2048801 4/1993
(Continued)

OTHER PUBLICATIONS

International Search Report (dated Sep. 15, 2017) for corresponding International App. PCT/SE2017/050666.

*Primary Examiner* — Stephen Johnson
*Assistant Examiner* — Benjamin S Gomberg
(74) *Attorney, Agent, or Firm* — WRB-IP LLP

(57) ABSTRACT

An ammunition loading system for loading ammunition into a primary magazine in an automatic cannon includes at least one secondary magazine arranged in an ammunition store beneath the primary magazine of the automatic cannon, a hoisting device for transporting the aforementioned at least one secondary magazine from the ammunition store to the primary magazine, a docking and transfer mechanism for the docking of the secondary magazine with the primary magazine and for the transfer of ammunition between the secondary magazine and the primary magazine, as well as a common drive arrangement for synchronous driving of the secondary magazine and the primary magazine during the
(Continued)

transfer of ammunition. A method for the aforementioned ammunition loading system is also provided.

10 Claims, 9 Drawing Sheets

(51) Int. Cl.
*F41A 9/04* (2006.01)
*F41A 9/21* (2006.01)

(58) Field of Classification Search
USPC ..... 89/46
See application file for complete search history.

(56) References Cited

U.S. PATENT DOCUMENTS 3,021,762 A 2/1962 Soderqvist
3,136,212 A 6/1964 Girouard et al.
3,306,165 A 2/1967 Christiansson
3,314,182 A * 4/1967 Harvey ..... F41A 9/37 42/18
3,359,859 A 12/1967 Herlach et al.
3,935,967 A 2/1976 Doucette
4,069,740 A * 1/1978 Hottinger ..... F41A 9/64 89/33.04
4,092,900 A * 6/1978 Hottinger ..... F41A 9/04 89/33.1
4,619,181 A 10/1986 Pehker et al.
4,640,181 A 2/1987 Schiele et al.
4,662,264 A * 5/1987 Kaustrater ..... F41A 9/01 89/33.1
4,777,863 A 10/1988 Dehaven et al.
4,798,123 A 1/1989 Svanstrom
4,840,110 A * 6/1989 Fischer ..... F41A 9/45 89/33.02
4,852,461 A 8/1989 Von Laar et al.
4,939,980 A * 7/1990 Zielinski ..... B65G 47/61 89/33.14
4,982,650 A * 1/1991 Bender-Zanoni ..... F41A 9/63 89/33.1
5,245,906 A 9/1993 Muller et al.
5,271,310 A * 12/1993 Muller ..... F41A 9/37 89/33.04
5,458,044 A 10/1995 Delbos
5,728,966 A 3/1998 Bobinger et al.
5,837,922 A 11/1998 Maher et al.
6,205,904 B1 3/2001 Boutet et al.
6,272,967 B1 * 8/2001 Bender-Zanoni ..... F41A 9/76 89/33.04
8,336,442 B2 * 12/2012 Testa ..... F41A 7/08 89/45
2008/0034952 A1 2/2008 Krause et al.
2010/0263526 A1 10/2010 Heldmann
2011/0114446 A1 * 5/2011 Burgermeister ..... B66F 3/18 198/468.2

FOREIGN PATENT DOCUMENTS

CH 665276 A6 4/1988
CH 690286 A5 6/2000
DE 2149954 4/1973
DE 3046642 A1 7/1982
DE 3642920 A1 6/1988
EP 17591 4/1983
EP 0152549 A1 8/1985
FR 2585819 A1 2/1987
GB 191400382 1/1915
GB 1492815 11/1977
GB 1539785 2/1979
SE 466872 4/1992
WO 9825095 A1 6/1998
WO 2015069167 A1 5/2015

* cited by examiner a)

b)

C)
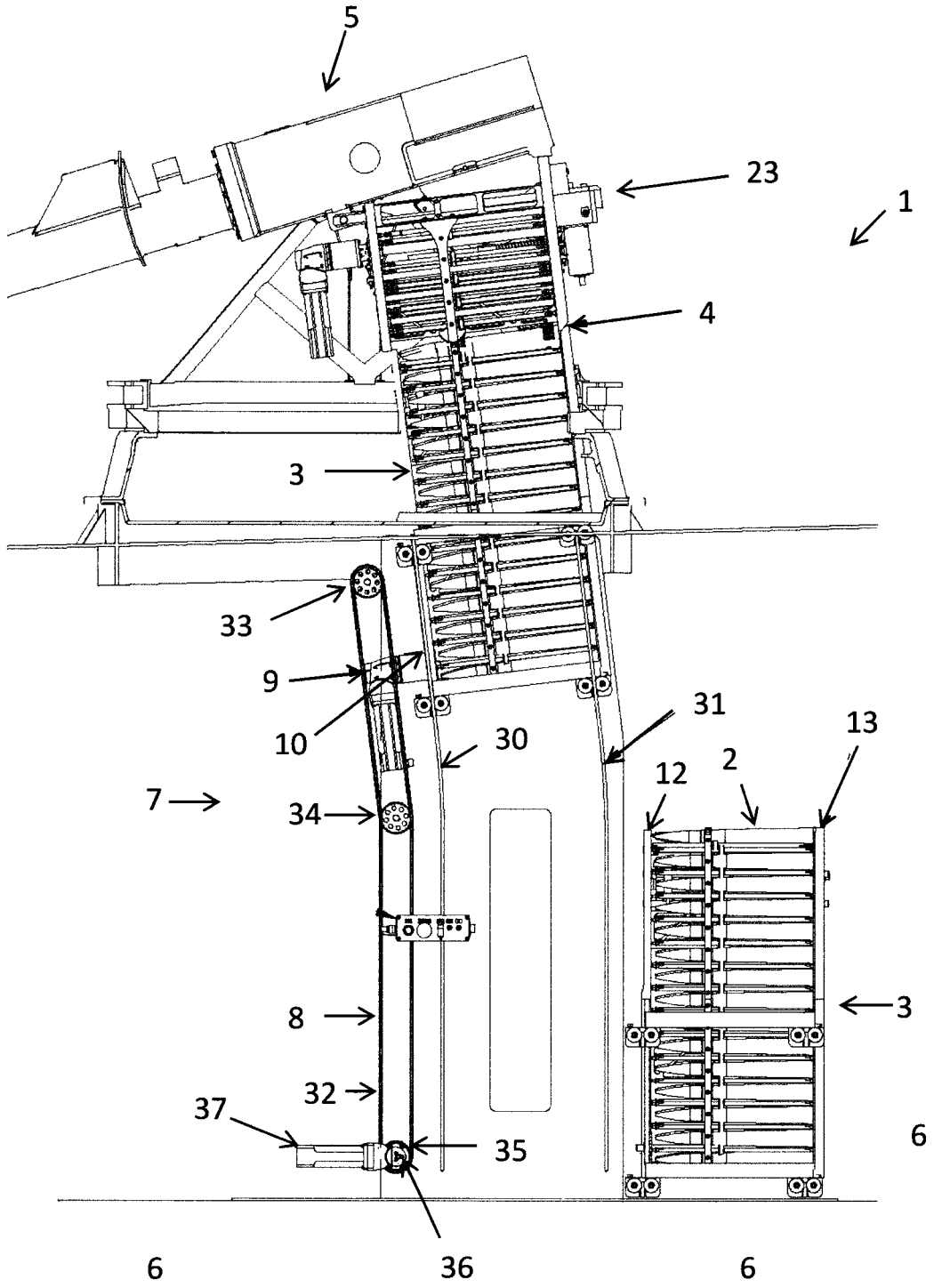

b)

c)
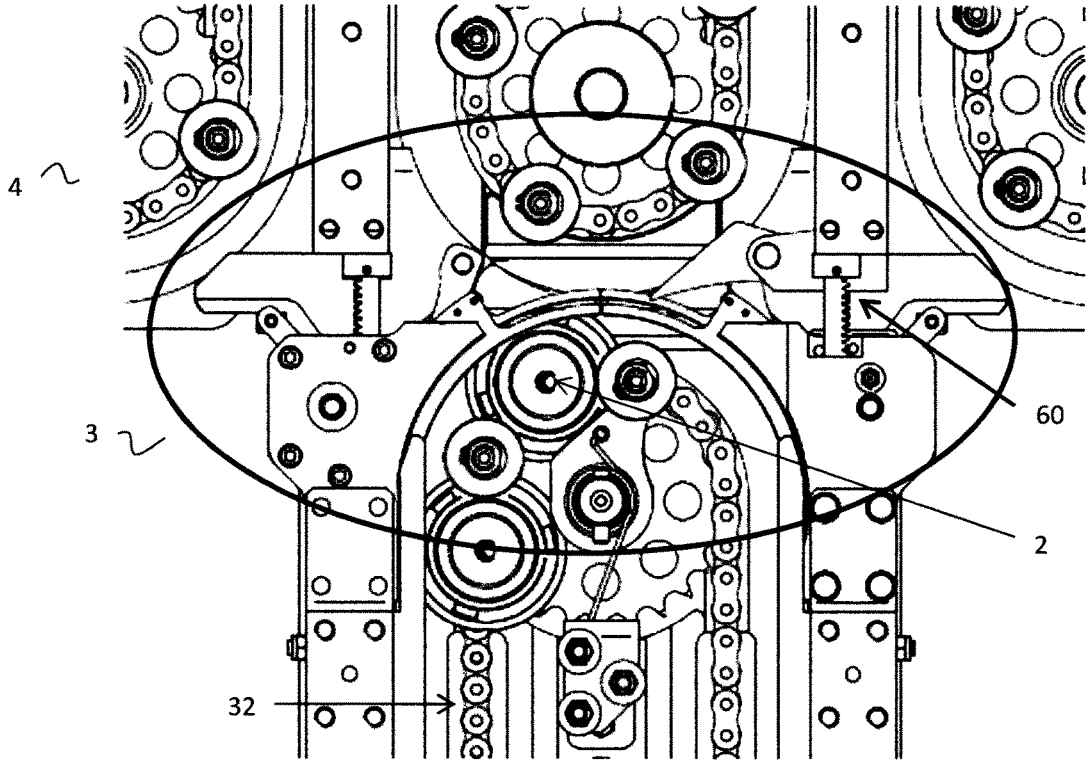
d)
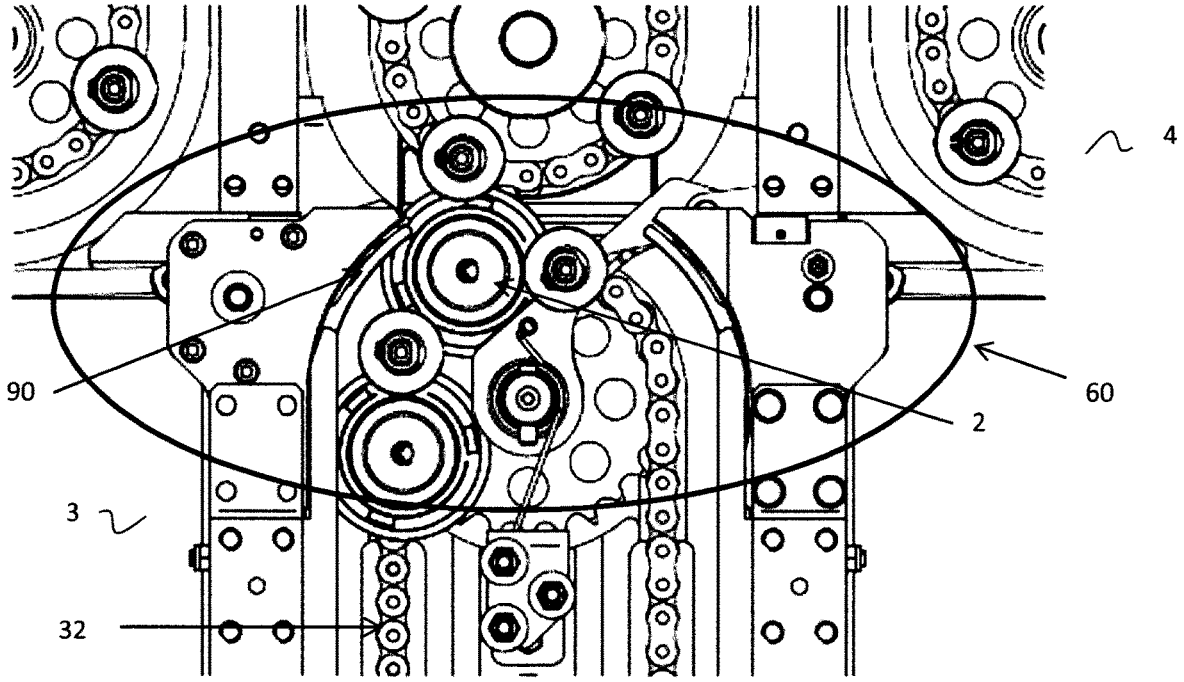

e)
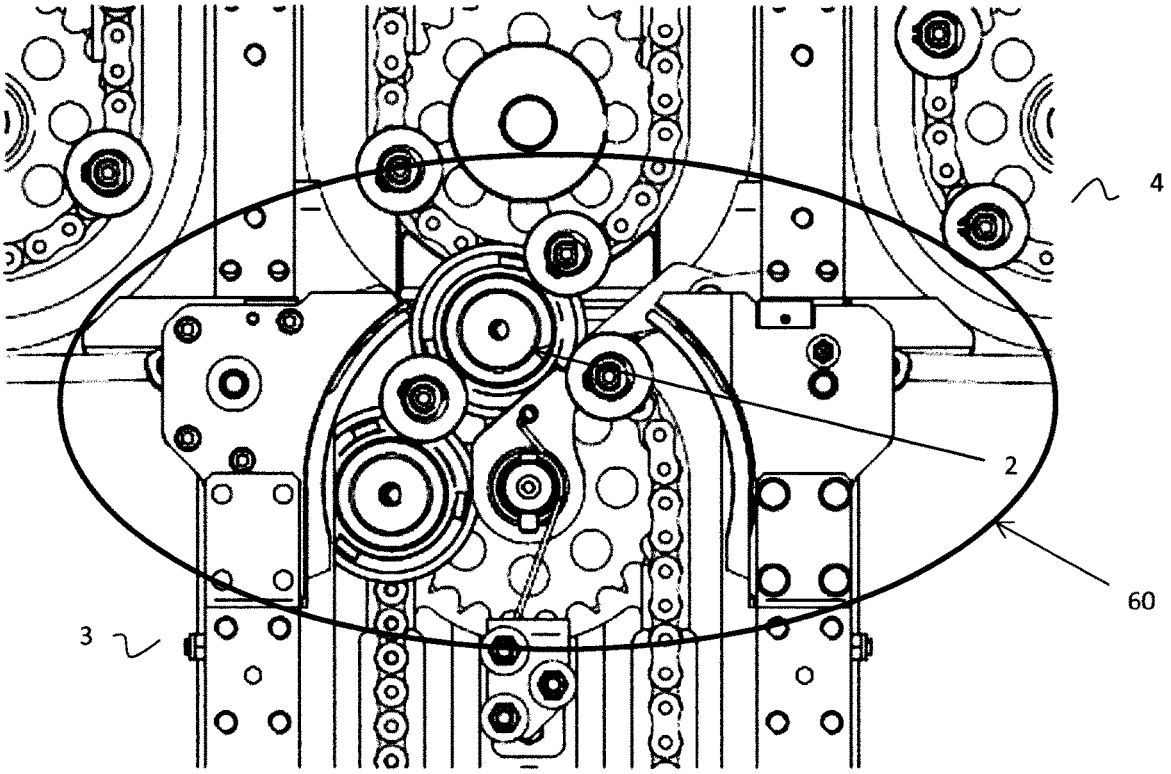
f)
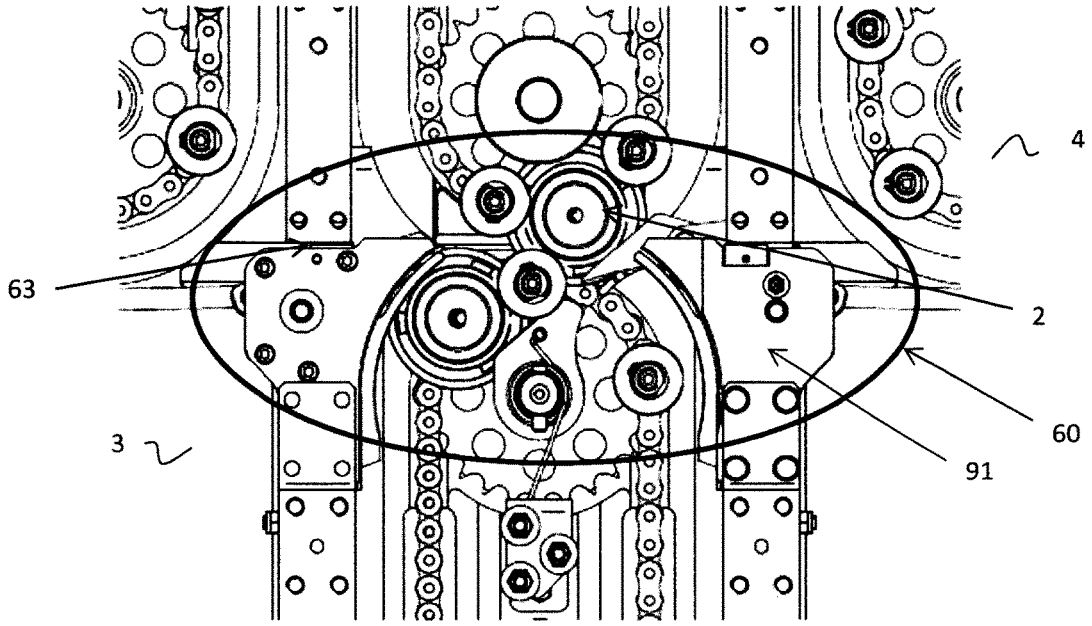

a)

b)

c)

SYSTEM AND METHOD FOR THE REVERSIBLE TRANSFER OF AMMUNITION BETWEEN A PRIMARY MAGAZINE AND A SECONDARY MAGAZINE IN AN AUTOMATIC CANNON

BACKGROUND AND SUMMARY

The present invention relates to a system and a method for the reversible transfer of ammunition between an external transfer magazine, referred to as a secondary magazine, and a primary magazine, for example in an automatic cannon.

Systems for loading ammunition from a secondary magazine to a primary magazine in an automatic cannon are known from the prior art. Known loading systems are, however, characterized by their low transfer speed and by their limited opportunities for handling mixed types of ammunition.

SE466872B describes a loading system for loading ammunition from a secondary magazine to a primary magazine in connection with an automatic cannon. The system comprises two ammunition drums, being a first upper rotatable ammunition drum corresponding to a primary magazine, and a second rotatable ammunition drum corresponding to a secondary magazine, arranged beneath the first ammunition drum.

The primary magazine comprises an ammunition outlet for the manual transfer of ammunition to the cannon's charging mechanism, and an ammunition inlet for the manual loading of ammunition from the secondary magazine to the primary magazine. The secondary magazine comprises an ammunition outlet for the manual transfer of ammunition from the secondary magazine to the primary magazine and an ammunition inlet for the manual loading of ammunition from an ammunition stock to the secondary magazine. The transfer of ammunition between the two magazines is performed with the help of an electric lifting device arranged in the form of a height-adjustable articulated arm mechanism of the parallelogram type, via two openable hatches between the two magazines.

The above-mentioned system with an articulated arm mechanism for the manual handling and transfer of ammunition between the magazines is a complicated and time-consuming method. During repeated automatic fire with an automatic cannon, there is a requirement for the flow of ammunition to the automatic cannon to take place without interruption. This is especially important during the shooting of automatic fire where rounds that are fired in periods one after the other are expected to hit one and the same target substantially at the same time as previously fired rounds. There is also a requirement for the system to be capable of handling mixed types of ammunition. Furthermore, the manual handling of ammunition presents a risk for both personnel and the environment.

It is desirable to make available a rapid and secure system and method for the reversible transfer of ammunition between a secondary magazine and a primary magazine, for example in an automatic cannon.

The aforementioned invention permits, according to an aspect thereof, the shooting of repeated automatic fire with interruptions only for loading ammunition to a primary magazine. Likewise, a system according to an aspect of the invention can be used in the opposite direction, that is to say during the emptying of a magazine.

It is also desirable to make available a system and a method which can handle mixed types of ammunition during the transfer of ammunition between a primary magazine and a secondary magazine.

A system for the reversible transfer of ammunition to or from a primary magazine, for example in an automatic cannon, is therefore made available according to the present invention. The aforementioned system comprises, in addition to a primary magazine, at least one transfer magazine, hereinafter referred to as a secondary magazine.

The secondary magazine can be arranged in an ammunition storage place situated beneath the primary magazine. The ammunition storage place can accommodate more than one secondary magazine, which are then in a ready position (RP) before being guided into the hoisting device beneath the primary magazine. In one embodiment, a secondary magazine is arranged directly in the hoisting device beneath the primary magazine in a bottom position (BP) or stand-by position (SP) in anticipation of being hoisted up to the docking position (DP). The secondary magazine or secondary magazines can also be positioned in an ammunition storage place which is arranged adjacent to the hoist. The hoisting device comprises a chain drive arrangement for transport of the aforementioned at least one secondary magazine from the bottom position up to the primary magazine.

A docking and transfer arrangement for docking the secondary magazine with the primary magazine permits the transfer of ammunition between the magazines. The docking and transfer mechanism is described more fully in the detailed description. The arrangement also comprises at least one drive arrangement for driving the secondary magazine and the primary magazine during the transfer of ammunition between the magazines.

According to a second embodiment of the system, the hoisting device is arranged in the form of two vertical self-supporting pairs of rails between the ammunition storage place and the primary magazine, being a front pair of rails and a rear pair of rails configured for the hoist transport of the secondary magazine, wherein the chain drive arrangement of the hoisting device, which is a freestanding construction separated from the pairs of rails, is attached and fixed to the outside of the two front pairs of rails.

According to a third embodiment of the system, the hoisting device is arranged in the form of a self-supporting framework comprising two parallel, side-mounted vertical pairs of members between the ammunition storage place and the primary magazine of the automatic cannon, wherein each of the two pairs of members is linked together via a lower transverse member, two intermediate transverse members and an upper transverse member, wherein, arranged on the insides of the two pairs of members, are four vertical parallel support rails, being two front support rails and two rear support rails, between which rails the secondary magazine is transported upwards and downwards to the primary magazine via the chain drive arrangement of the hoisting device, and wherein the chain drive arrangement is arranged in the framework in the form of a loop on the inside of the pair of members of the framework via chain wheels and drive wheels mounted on the transverse members of the framework.

According to a fourth embodiment of the system, the ammunition transfer system comprises a common drive arrangement for synchronous driving of the secondary magazine and the primary magazine during the transfer of one type of ammunition from the secondary magazine to the primary magazine.

According to a fifth embodiment of the system, the secondary magazine is driven by the drive arrangement of the primary magazine via a slave driver.

According to a sixth embodiment of the system, the ammunition transfer system comprises two separate drive arrangements for independent driving of the secondary magazine and the primary magazine during the transfer of mixed types of ammunition from the secondary magazine to different positions in the primary magazine.

According to a seventh embodiment of the system, the ammunition transfer system comprises a switching unit for switching between the common drive arrangement and the two separate drive arrangements.

According to an eighth embodiment of the system, the ammunition transfer system comprises a programmable control and monitoring unit for controlling and monitoring the hoisting device and the docking and transfer mechanism.

According to the present invention, a method for the reversible transfer of ammunition in an ammunition transfer system, comprising at least one secondary magazine arranged in a hoisting device beneath the primary magazine of an automatic cannon, has also been made available. The aforementioned hoisting device comprises a chain drive arrangement, a docking and transfer arrangement for the execution of the docking and transfer mechanism and at least one drive arrangement for driving the magazine. The method comprises the following steps: hoist transport of one secondary magazine at a time between the ammunition storage place and the primary magazine via the hoisting device, and docking and transfer of ammunition between the secondary magazine and the primary magazine via the docking and transfer arrangement and via the aforementioned at least one drive arrangement.

A rapid and secure system and method for the reversible transfer of ammunition between a secondary magazine and a primary magazine in an automatic cannon are achieved on the basis of what is proposed above.

Synchronous driving of the chain conveyors of the magazines via a common drive arrangement means the rapid and secure transfer of ammunition between the magazines with no risk or with a low risk of interruption in the transfer.

Automatic switching between a common drive arrangement and two separate drive arrangements for independent driving of the chain conveyors of the magazines means that a single type of ammunition as well as mixed types of ammunition can be handled during the ammunition transfer.

Activation of the docking and transfer mechanism via the operating force from the connecting secondary magazine during docking means the rapid and secure transfer of ammunition between the magazines.

BRIEF DESCRIPTION OF THE DRAWINGS

The invention is now described by way of example with reference to the accompanying drawings, in which.

DETAILED DESCRIPTION

Before the invention is described in detail, it must be appreciated that this invention is not restricted to specific materials or configurations that are disclosed herein. Suchlike configurations and materials may vary. It must also be appreciated that the terminology applied herein is used only to describe specific embodiments, and is not intended to be restrictive so that the scope of the present invention is restricted only by the attached claims.

The present invention will now be described in more detail with reference to the accompanying figures, in which different illustrative examples of the invention are depicted.

Figure 1:
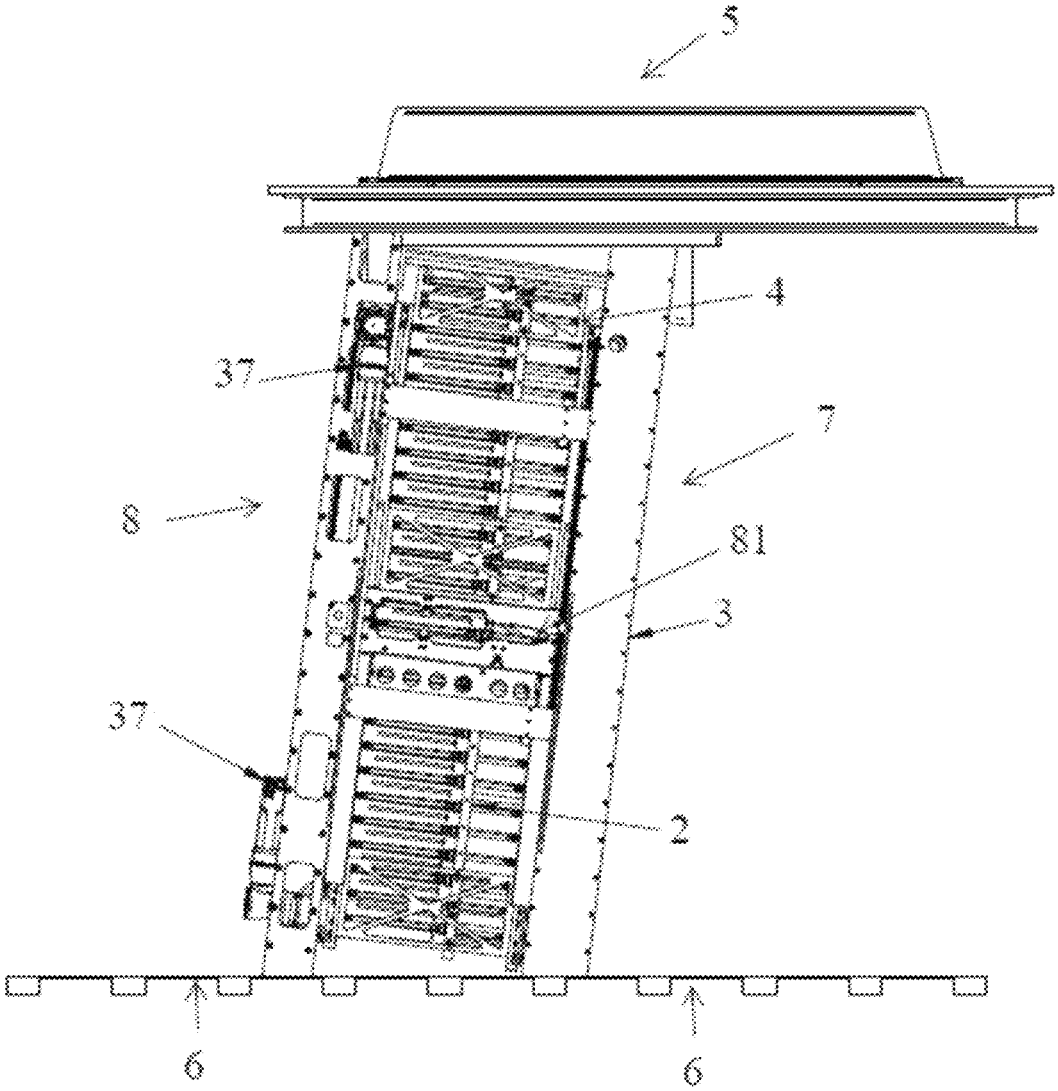
FIG. 1 depicts a schematic side view of a first embodiment of the transfer system comprising a secondary magazine arranged in a hoisting device beneath the primary magazine, for transport of the secondary magazine to the primary magazine for docking (a), as well as a more detailed side view of a hoisting device (b), and when a plurality of secondary magazines is used, they can be kept in a storage place in anticipation of being brought into the hoist, hoisted up and docked with the primary magazine (c).
Figure 1:
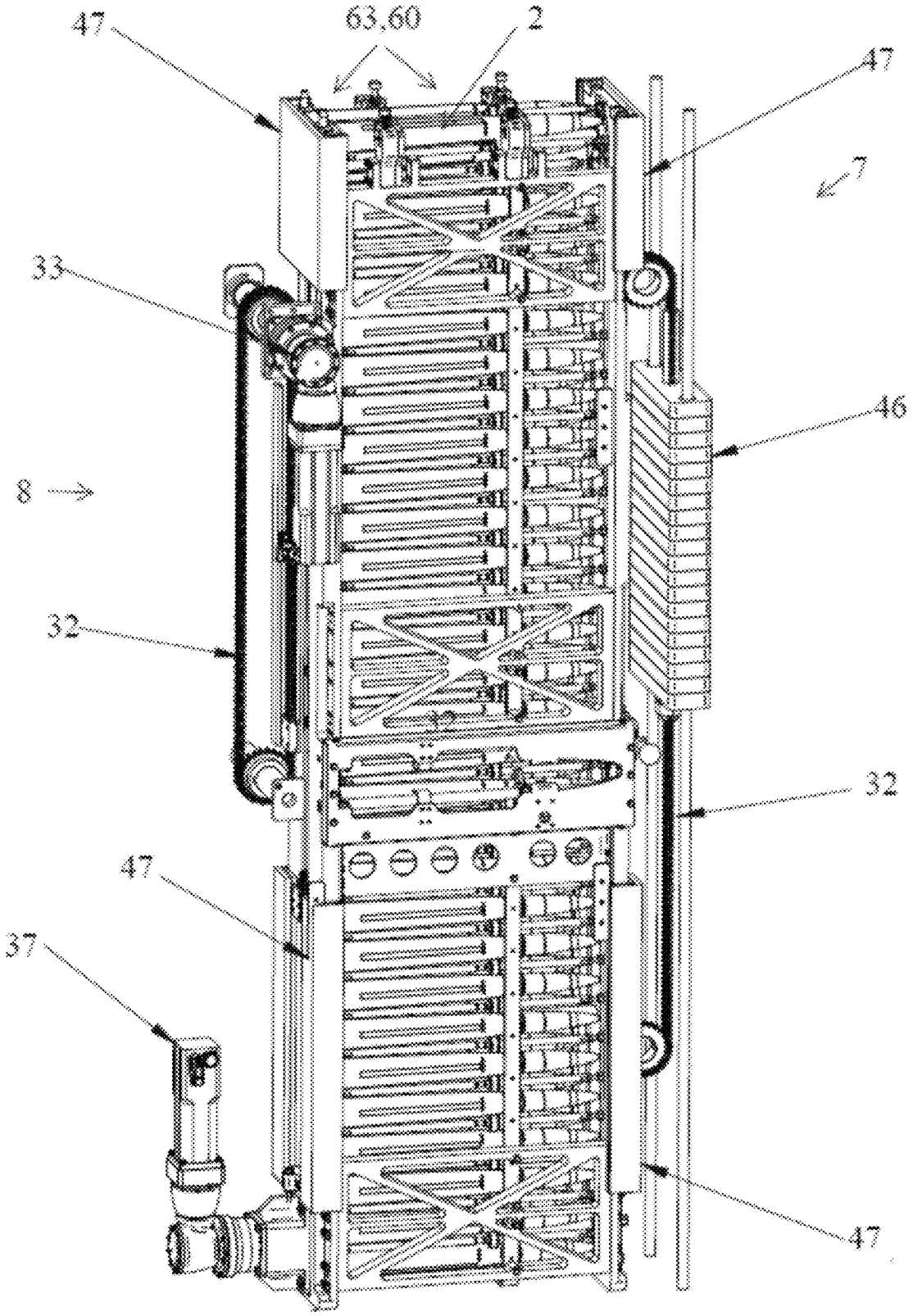

FIG. 1 depicts a side view of a first embodiment (a) of an ammunition transfer system 1 for the reversible transfer of ammunition from an ammunition transfer magazine, referred to as a secondary magazine 3, to a primary magazine 4 in an automatic cannon 5 (transfer can take place in both directions). The simplest form comprises only one secondary magazine 3. The secondary magazine 3 can be arranged beneath the primary magazine 4 in the hoisting device 7 for transport to and from the primary magazine 4. In one embodiment, the secondary magazine 3 can be securely mounted beneath the primary magazine 4 in the hoisting device 7.

The secondary magazine can also be kept outside the hoisting device 7 in a so-called ammunition storage place 6.

The secondary magazine may contain 60 rounds, for example, as in FIG. 1*a*, although it is not restricted to that number. For example, it may also contain 30 rounds.

Figure 3:
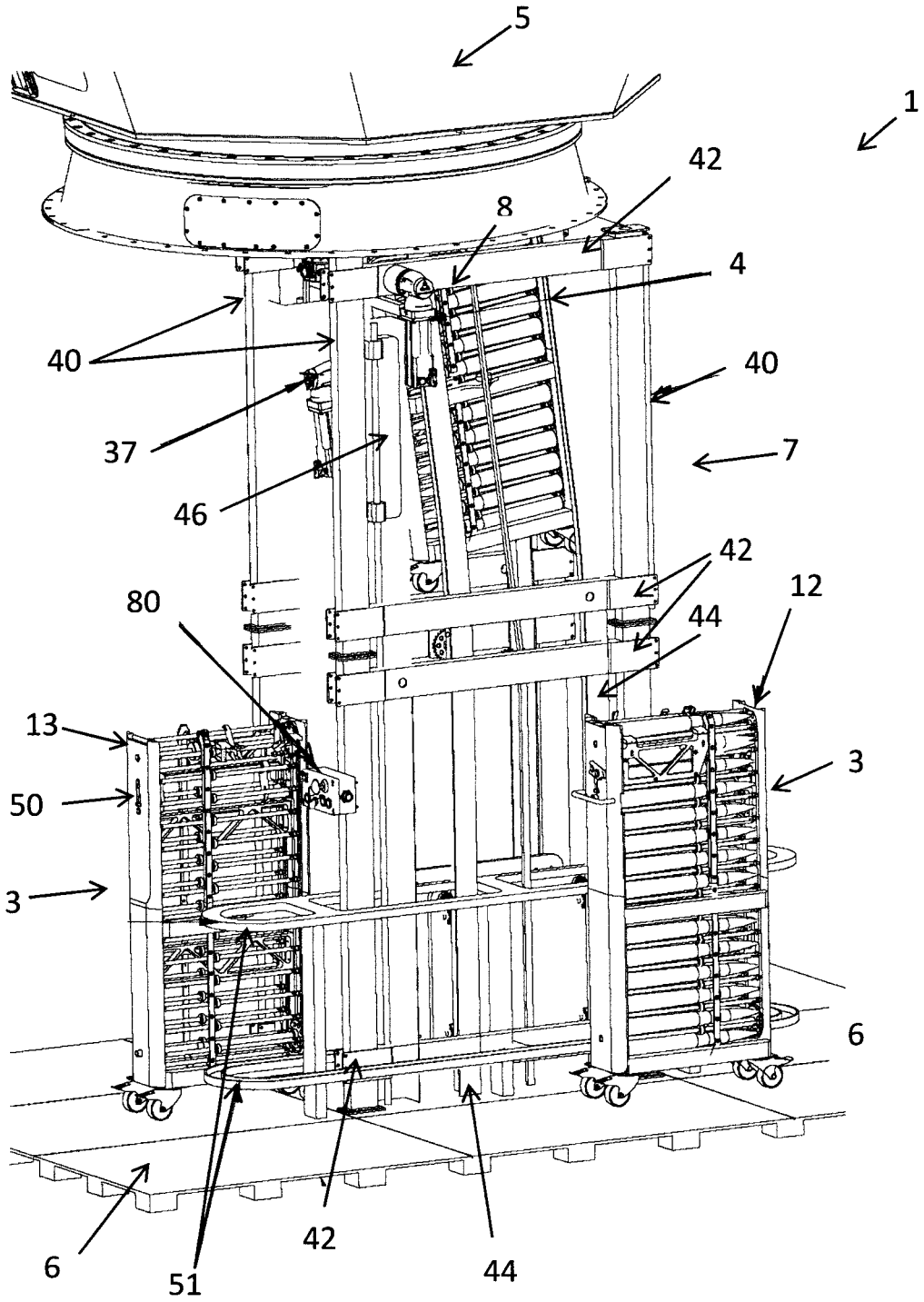
FIG. 3 depicts a schematic side view of an ammunition transfer system and its ammunition storage place, comprising three secondary magazines.

FIG. 1*b* depicts the hoisting device 7 in more detail, which device is driven by a chain drive arrangement 8 to which the secondary magazine 3 is docked for the hoist transport to and from the primary magazine 4. The secondary magazine 3 is docked to the chain drive arrangement 8 via a docking arrangement 9 comprising a locking and coupling arrangement, which is depicted in FIG. 3. The chain drive arrangement 8 is arranged in the framework in the form of a loop on the inside of the vertical pair of members 40 of the framework via chain wheels and drive wheels mounted on the transverse members 41, 42, 43 of the framework. Arranged on the drive chain 32 of the chain drive arrangement 8 is a counter-weight 46 (FIG. 1*b*) for equalizing any imbalance which may occur during operation. In the second embodiment 1, the drive chain 32 is also driven, preferably by an electric motor 37. 47 are linear bearings which are guided in a linear fashion. FIG. 1*c* depicts how a secondary magazine 3 is present in the ammunition storage place 6 and is waiting to be introduced into the hoisting device 7, is docked to the chain drive arrangement 8 via a docking arrangement 9 which comprises a locking and coupling arrangement before subsequently being hoisted up to the primary magazine 4.

Figure 2A:
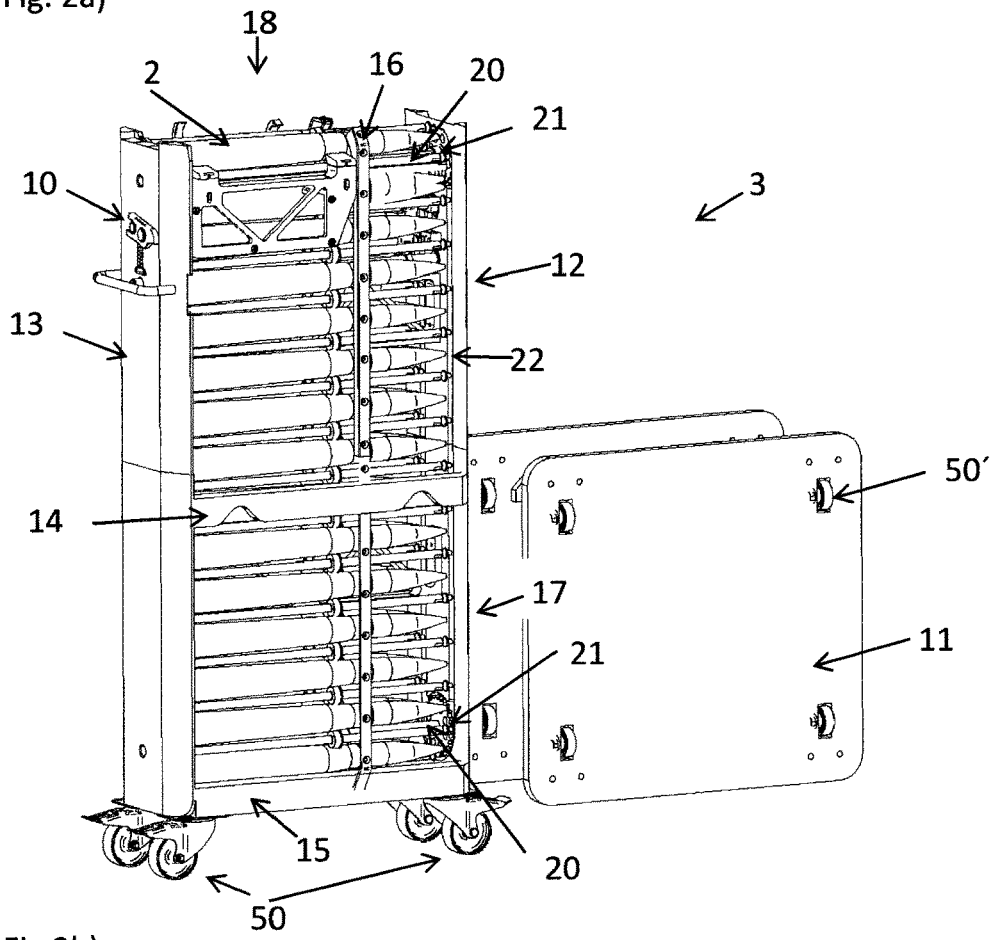
FIG. 2 *a* and *b* depict a schematic perspective view of a secondary magazine and a transport carriage respectively unmounted (a) and mounted (b) on the secondary magazine.

FIGS. 2*a* and *b* depict a transport carriage 11 unmounted (a) and mounted (b) on a secondary magazine 3. The secondary magazine 3 is constructed in an equivalent manner to the primary magazine 4 with two end walls facing towards one another, the end walls being a front end wall 12 and a rear end wall 13, which are held together by two transverse members, the transverse members being an intermediate transverse member 14 and a lower transverse member 15 between the two end walls 12, 13, and a central support 16 mounted on the transverse members 14, 15. The secondary magazine 3 further comprises a chain conveyor 17 for feeding the ammunition 2 to an ammunition outlet 18 on the upper side of the secondary magazine 3, where the transfer of ammunition 2 takes place to a corresponding ammunition inlet on the underside of the primary magazine 4.

In a corresponding manner, the primary magazine 4 comprises a chain conveyor, not illustrated here, for feeding the ammunition 2 to an ammunition outlet on the upper side of the primary magazine 4, where the transfer of the ammunition 2 takes place to the breech casing of the automatic cannon 5.

Also included in the secondary magazine 3 are two drive shafts 20, each having two chain wheels 21 for the synchronization of two separate drive chains 22 arranged in front and rear end walls 12, 13 of the secondary magazine 3. The two drive chains 22 drive the chain conveyor 17 of the secondary magazine 3 and distribute the driving force from an electric drive arrangement 23 to the two drive chains 22.

The transport carriage 11 is configured so that the secondary magazine 3 can be easily attached/mounted (b) to the transport carriage 11 during the hoist transport.

The transport carriage 11 comprises external wheels 50, which run on the slide rails 44, 45 of the framework during the hoist transport (see FIG. 3).

In a further embodiment, the locking and coupling arrangement can comprise a lock hook arranged on the chain drive arrangement 8, not illustrated here, which is then hooked securely in a recess or on a frame on the front end wall 12 of the secondary magazine 3, or alternatively on the transport carriage 11. The position of the lock hook can then be secured via a transverse locking bolt. In another embodiment of the locking and coupling device, this consists of or comprises a remotely controlled magnetic lock, not illustrated here.

In the primary magazine 4, seven drive shafts and seven chain wheels are used to ensure that the drive chains are always synchronized with one another even if any of the drive chains are slack, not depicted here. The drive chains of the primary magazine 4 can also be adjusted manually via a chain adjustment mechanism.

In a special embodiment, the transport carriage 11 is securely mounted on the drive chain of the chain drive arrangement 8 via screwed, bolted or clamped joints between the drive chain and the outsides of the transport carriage 11.

FIG. 3 depicts a second embodiment of an ammunition transfer system 1 adapted so as to be capable of accommodating and feeding a plurality of secondary magazines 3 to and from the primary magazine 4. The secondary magazines 3 are positioned in that part of the ammunition storage place 6 that is arranged beneath the primary magazine in a hoisting device 7. The actual transport upwards to the primary magazine 4 takes place in the same way as in the first embodiment. A plurality of secondary magazines 3 can be set up in the ammunition storage place 6 outside the hoisting device in anticipation of being brought into the hoisting device 7 before being hoisted up and docked with the primary magazine 4.

Figure 2B:
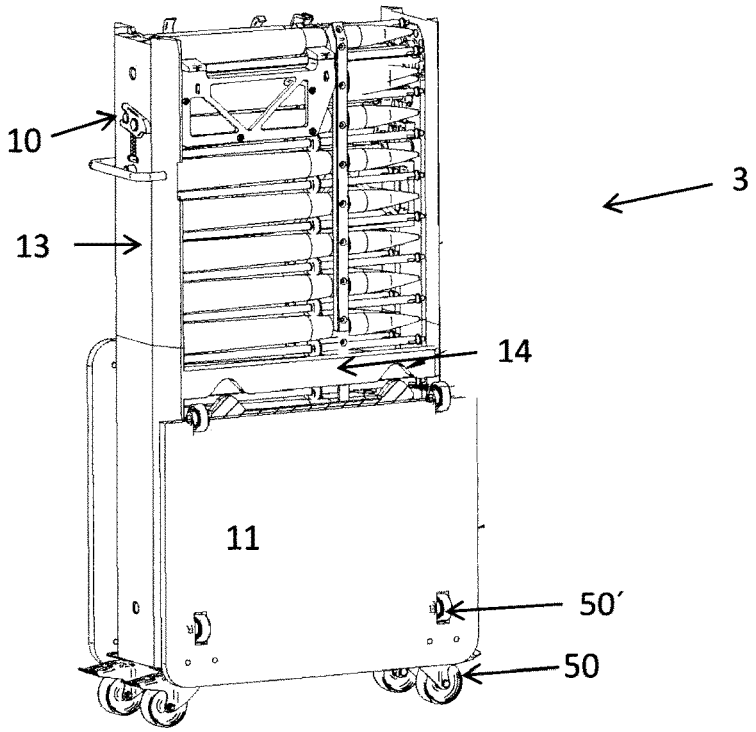

Secondary magazines 3 that are parked in the ammunition storage place 6 outside the hoisting device according to the second embodiment are rolled forwards to the ammunition storage place 6, whereupon it is positioned and locked securely in a transport carriage 11 (see FIG. 2). The magazine can then be brought into the hoisting device 7, and the hoist transport can begin directly once the transport carriage 11 is securely mounted on the chain drive arrangement 8.

In one embodiment, when more than one magazine is waiting in turn in the ammunition storage place 6 for feeding, the locking and coupling arrangement 10 can be arranged on a transport carriage 11, wherein the secondary magazine 3 is docked to the chain drive arrangement 8 via the transport carriage.

In another embodiment, the hoisting device 7 of the transfer system 1 is arranged in the form of a self-supporting framework comprising two parallel, side-mounted vertical pairs of members 40 between the magazine store 6 and the primary magazine 4 of the automatic cannon 5.

Each of the pairs of members 40 is linked together via a lower pair of transverse members 41, two intermediate pairs of transverse members 42 and an upper pair of transverse members 43. Arranged on the insides of the two vertical pairs of members 40 are four vertical parallel support rails 44, 45. Two front support rails 44 and two rear support rails 45, between which the transport carriage 11 with a secondary magazine 4 mounted is transported up and down to the primary magazine 3 via the chain drive arrangement 8 of the hoisting device 7.

The ammunition storage place 6 can have two horizontal guide rails 51 arranged for controlling the secondary magazines 3 in the horizontal plane during the rolling transport to and from the docking position of the hoisting device 7. The guide rails 51, being one lower and one upper guide rail, are securely mounted on the outsides of the pair of members 40 of the framework.

The different embodiments of the ammunition transfer system ammunition store 1 comprise at least one, two or preferably three secondary magazines 3, or more.

In an alternative embodiment, the hoisting device 7 is driven by a pinion instead of a drive chain, not illustrated here. In a further, alternative embodiment, the hoisting device 7 is driven via a winch and counter-weights, not illustrated here.

The link arm systems of the magazines 3, 4 are driven via separate drive chains arranged in the front and rear end wall parts of the respective magazine 3, 4. The drive chains are synchronized with one another via the drive shafts of the chain conveyors, wherein the drive shafts distribute the driving force from a programmable drive arrangement that is capable of engagement and disengagement, not illustrated here.

The ammunition 2 is transported round in the respective magazine 3, 4 on guide rods, which are connected to the link arm systems via mounting pins, not illustrated here.

The transfer of ammunition 2 between the magazines 3, 4 can take place forwards or backwards depending on whether the primary magazine 4 is to be filled or emptied. For example, the primary magazine must be emptied in the event of a change of the type of ammunition.

In one embodiment, the link arm system of the secondary magazine 3 is driven synchronously with the link arm system of the primary magazine 4 via a slave driver connected to the drive arrangement 23 of the primary magazine 3.

The drive arrangement of the primary magazine 4 is capable of engagement and disengagement and is controlled manually via a control and monitoring unit. Alternatively, the drive arrangement can be remotely controlled.

The slave driver is mounted on the front end wall 12 of the secondary magazine 3 and is attached/connected to one of the drive wheels 21 of the secondary magazine 3. Synchronous driving of the link arm systems of the two magazines permits the rapid and secure transfer of ammunition between the magazines 3, 4.

Figure 4:
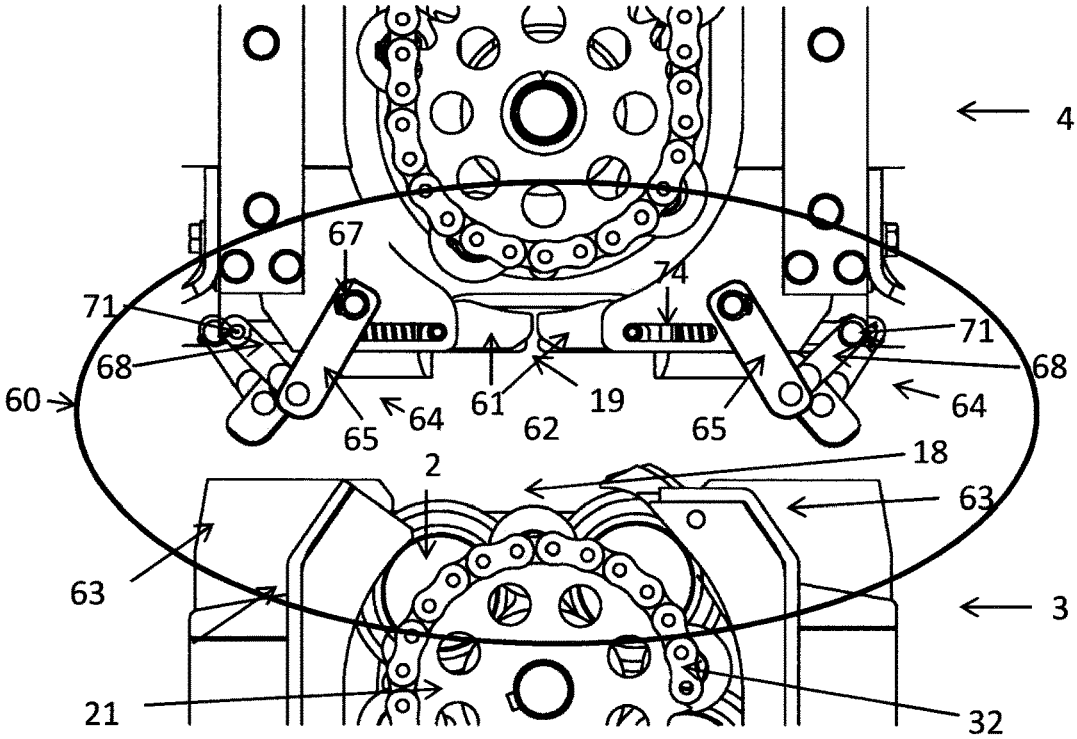
FIG. 4 *a-f* depict a schematic detailed view of the hoisting of the secondary magazine, the ammunition outlet and the ammunition inlet of the primary magazine before docking (a, b) the docking (c) of the magazines and the transfer of ammunition from the secondary magazine to the primary magazine (c, d, e) and after transfer (f).
Figure 4:
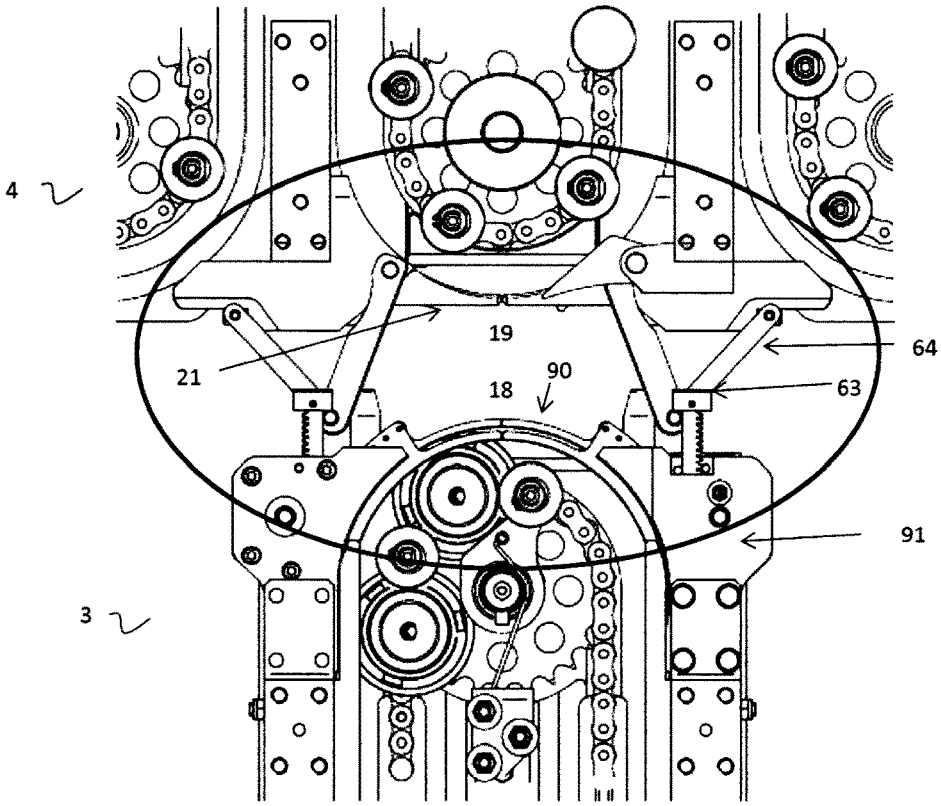

FIG. 4 *a-f* depict the docking and transfer process, where hoisting and started docking (a, b), docking in (c), when the ammunition transfer between the magazines 3, 4 has started (d), has come half-way (e) and the position of the docking arrangement after the completed transfer of ammunition 2 between the magazines 3, 4 (*f*). The area within a circle in the respective image illustrates the docking mechanism. The secondary magazine is hoisted up towards the primary magazine (a), and the docking is activated by the force which the movement in the connecting secondary magazine 3 exerts on the primary magazine 4 in the course of docking of the magazines 3, 4 (*b*). Via four contact surfaces 63 arranged on the ammunition outlet 18 of the secondary magazine 3 (inlet during emptying), the force is transferred to the docking arrangement via four, preloaded, V-shaped projecting articulation mechanisms, referred to as articulations 64, arranged in the corners of the ammunition inlet 19 of the primary magazine 4 and are movably connected to the four movable locking bolts 61, so that the locking bolts 61 are displaced radially, during activation of the articulations 64, from the closed blocking position to the open position in the ammunition inlet of the primary magazine 4. The locking arrangement of the secondary magazine is described in more detail in FIGS. 5*a* and *b*. The chain conveyors of the secondary magazine 3 and the primary magazine 4 comprises a link arm system comprising star-shaped drive wheels 21, which, after docking of the magazines 3, 4, are positioned and synchronized with one another so that the ammunition 2 is transferred between the link arm systems of the magazines 3, 4 via the transfer channel 62 that is released after docking.

A transfer channel 62 between the magazines 3, 4 opens (a), whereupon the transfer of ammunition 2 between the magazines 3, 4 can begin (d). During the return transport of the secondary magazine 3 to the ammunition storage place, the articulations 64, under the influence of the preloading on the articulation mechanisms, return to their starting positions projecting from the primary magazine 4. At the same time, the four locking bolts 61 return to their closed starting positions in the ammunition inlet 19 of the primary magazine 4 (outlet during emptying). The movement of the secondary magazine 3 during docking (b, c) thus regulates the position of the locking bolts 61 between the closed and open position in the ammunition inlet 19 of the primary magazine 4. The outlet 18 of the secondary magazine 3 is likewise closed when the contact surfaces 63 return to the non-preloaded starting position (see also FIG. 5*b*).

In a second embodiment of the driving of the magazines 3, 4, not illustrated here, in respect of the transfer of mixed types of ammunition, two independent drive arrangements can be used instead of a common drive arrangement. The chain conveyors of the magazines 3, 4 are driven here by separate independent drive arrangements, being one drive arrangement for each chain conveyor. The two independent drive arrangements each comprise control and monitoring functions for independent driving of the respective link arm system, forwards or backwards, at the same or at different speeds.

Independent driving of the link arm systems permits, for example, the transfer of different types of ammunition 2 from the secondary magazine 3 to different positions in the primary magazine 4. Having regard for the question of whether one or a plurality of types of ammunition 2 must be used, the possibility also exists for alternating automatically, via a switching unit, between common synchronous or separate independent driving of the magazines 3, 4 by engaging or disengaging the slave driver and respectively engaging or disengaging the other independent drive arrangement.

Figure 5:
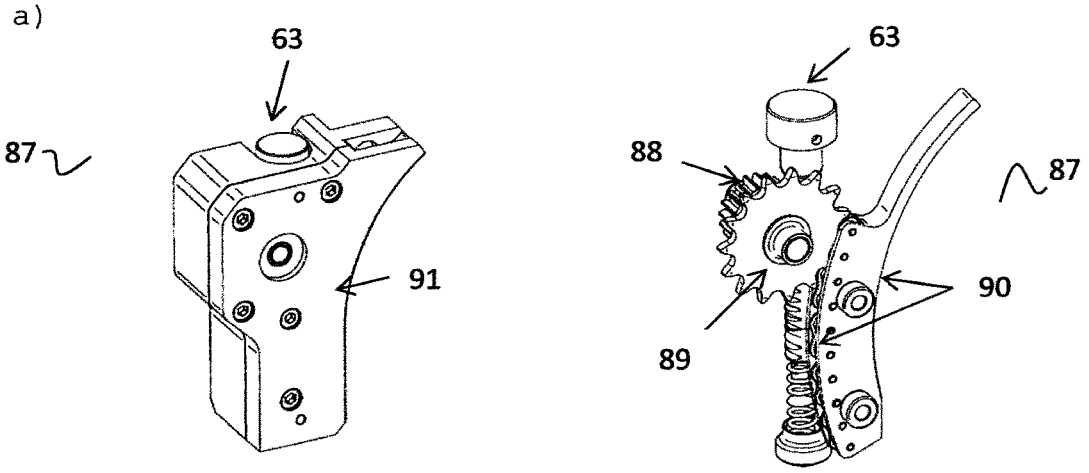
FIG. 5*a* to *c* depict the gate device respectively in the open position (a) and in the closed (b) position, and the articulation (c) of the primary magazine.
Figure 5:
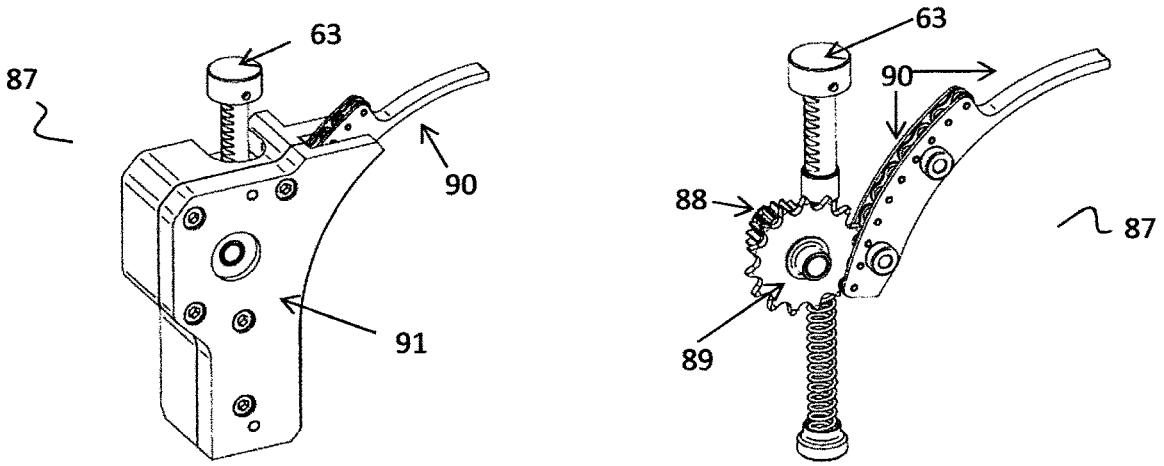
Figure 5:
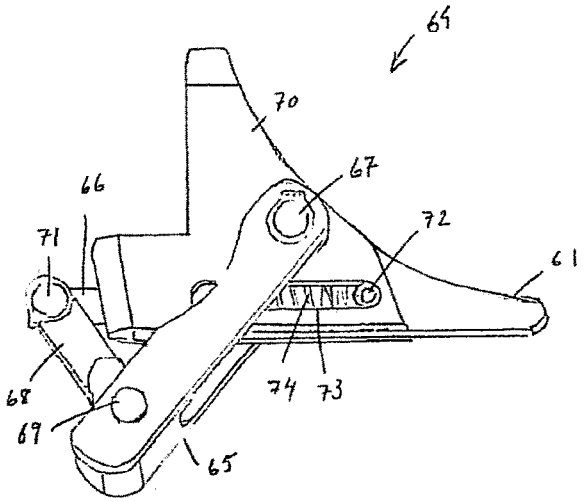

FIGS. 5*a* and *b* depict the gate device 87 in the secondary magazine 3 in the open (a) and respectively in the closed (b) position. The arrangement consists of or comprises a contact surface 63 in the form of a sprung toothed rack, a toothed wheel 88, a chain wheel 89 and a chain link 90, which are enclosed by a casing 91. The gate device is opened in that the contact surface 63 is pressed down by the contact between the magazines 3, 4, whereupon the toothed wheel 88 rotates and drives the chain wheel 89, and with it the chain link 90, into the open position (a). When separation of the magazines begins, the arrangement returns to the closed position when the movement of the magazines away from one another releases the pressure on the contact surface 63.

The articulations 64 are depicted in more detail in FIG. 5*c*. The double-acting slide 70 is arranged in a controllable manner, in the radial direction, in relation to the locking bolt 61 via guide pins 72 arranged on the outsides of the locking bolt 61, wherein the guide pins 72 are controllable in longitudinal guide slots 73 on the sides of the double-acting slide 70. The articulations 64 and the locking bolts 61 are preloaded via a compression spring 74 arranged in the double-walled slide 70 between the drawing piston 66 and the locking bolt 61. The compression spring 74 is of a conventional kind and is not described in more detail in the rest of the text.

The ammunition transfer system 1 also comprises a central control and monitoring unit 80 for controlling both the hoisting device 7 and the docking and transfer device 60.

The central control and monitoring unit 80 is preferably remotely controlled, but can also be controlled manually via a keypad on the control and monitoring unit 80.

The invention claimed is:

1. An ammunition transfer system for reversibly transferring ammunition in an automatic cannon, comprising:

a primary magazine, at least one secondary magazine, a hoisting device comprising a chain drive arrangement for transporting the at least one secondary magazine to the primary magazine, a docking and transferring arrangement for docking the at least one secondary magazine with the primary magazine and for transferring the ammunition between the at least one secondary magazine and the primary magazine, wherein the at least one secondary magazine and the primary magazine each comprise a respective chain conveyor for feeding the ammunition to ammunition outlets of the at least one secondary magazine and the primary magazine, wherein the respective chain conveyors are driven synchronously with one another via at least one drive arrangement for driving the at least one secondary magazine and the primary magazine when the ammunition is transferred between the at least one secondary magazine and the primary magazine, and wherein the docking and transferring arrangement and the at least one drive arrangement are configured to reversibly transfer all ammunition in the primary magazine to the at least one secondary magazine.

2. The ammunition transfer system as claimed in claim 1, wherein the hoisting device comprises two vertical self-supporting pairs of rails beneath the primary magazine, the two pairs of rails comprising a front pair of rails and a rear pair of rails, configured for transporting the at least one secondary magazine, wherein the chain drive arrangement of the hoisting device is attached and fixed to an outside of the front pair of rails.

3. The ammunition transfer system as claimed in claim 1, further comprising a common drive arrangement for synchronized driving of the at least one secondary magazine and the primary magazine when the ammunition is transferred from the at least one secondary magazine to the primary magazine.

4. The ammunition transfer system as claimed in claim 1, further comprising two separate drive arrangements for independent driving of the at least one secondary magazine and the primary magazine when the ammunition comprises mixed types of ammunition which are transferred from the at least one secondary magazine to different positions in the primary magazine.

5. The ammunition transfer system as claimed in claim 4, further comprising a switching unit for switching between a common drive arrangement and the two separate drive arrangements.

6. The ammunition transfer system as claimed in claim 1, further comprising a programmable control and monitoring unit for controlling and monitoring the hoisting device and the docking and transferring arrangement.

7. A method for reversibly transferring the ammunition in the ammunition transfer system as claimed in claim 1, wherein the method comprises:

transporting the at least one secondary magazine to the primary magazine via the hoisting device, docking the at least one secondary magazine with the primary magazine, transferring ammunition from the at least one secondary magazine to the primary magazine via the docking and transferring arrangement and via the at least one drive arrangement, and reversibly transferring all ammunition in the primary magazine to the at least one secondary magazine via the docking and transferring arrangement and via the at least one drive arrangement.

8. The method as claimed in claim 7, wherein the at least one secondary magazine is arranged in a transport carriage and is subsequently docked to the chain drive arrangement of the hoisting device.

9. An ammunition transfer system for reversibly transferring ammunition in an automatic cannon, comprising:

a primary magazine, at least one secondary magazine, a hoisting device comprising a chain drive arrangement for transporting the at least one secondary magazine to the primary magazine, a docking and transferring arrangement for docking the at least one secondary magazine with the primary magazine and for transferring the ammunition between the at least one secondary magazine and the primary magazine, wherein the at least one secondary magazine and the primary magazine each comprise a respective chain conveyor for feeding the ammunition to ammunition outlets of the at least one secondary magazine and the primary magazine, wherein the respective chain conveyors are driven synchronously with one another via at least one drive arrangement for driving the at least one secondary magazine and the primary magazine when the ammunition is transferred between the at least one secondary magazine and the primary magazine, wherein the hoisting device comprises a self-supporting framework comprising two parallel side-mounted vertical pairs of members between an ammunition store and the primary magazine, wherein the two pairs of members are each linked together via a lower pair of transverse members, two intermediate pairs of transverse members and an upper pair of transverse members, wherein, arranged on an inside of the two vertical pairs of members, are four vertical parallel support rails, two of the four vertical support rails being front support rails and two of the four vertical support rails being rear support rails, between the front support rails and the rear support rails the at least one secondary magazine is transported upwards and downwards to the primary magazine via the chain drive arrangement of the hoisting device, wherein the chain drive arrangement is arranged in the framework as a loop on the inside of the two vertical pairs of members of the framework via chain wheels and drive wheels mounted on the lower pair of transverse members, the two intermediate pairs of transverse members and the upper pair of transverse members of the framework.

10. An ammunition transfer system for reversibly transferring ammunition in an automatic cannon, comprising:

a primary magazine, at least one secondary magazine, a hoisting device comprising a chain drive arrangement for transporting the at least one secondary magazine to the primary magazine, a docking and transferring arrangement for docking the at least one secondary magazine with the primary magazine and for transferring the ammunition between the at least one secondary magazine and the primary magazine, wherein the at least one secondary magazine and the primary magazine each comprise a respective chain conveyor for feeding the ammunition to ammunition outlets of the at least one secondary magazine and the primary magazine, wherein the respective chain conveyors are driven synchronously with one another via at least one drive arrangement for driving the at least one secondary magazine and the primary magazine when the ammunition is transferred between the at least one secondary magazine and the primary magazine, wherein the docking and transferring arrangement comprises four locking bolts arranged in a corner of an ammunition inlet of the primary magazine, four preloaded, V-shaped projecting articulations, movably connected to the four locking bolts, so that the locking bolts, during activation of the articulations, are displaced radially from a closed blocking position into an open position in the ammunition inlet of the primary magazine, wherein the at least one secondary magazine comprises four gate devices arranged in the corners of the ammunition outlets of the at least one secondary magazine, each said gate device being enclosed by a casing comprising a contact surface, a toothed wheel, a chain wheel and a chain link arranged in conjunction with the chain wheel which is driven by the toothed wheel, so that, when the at least one secondary magazine is transported towards the primary magazine and the articulations meet the at least one secondary magazine, the articulations are thereby forced sideways so that the ammunition outlet is opened at the same time as the primary magazine pushes the contact surface down onto the at least one secondary magazine which drives the toothed wheel and the chain wheel in order to draw back the chain link, wherein the ammunition outlet in the at least one secondary magazine is opened so that the ammunition can be transferred between the primary magazine and the at least one secondary magazine.

* * * * *